US010689839B2

(12) United States Patent
Wheatley

(10) Patent No.: US 10,689,839 B2
(45) Date of Patent: Jun. 23, 2020

(54) PARKING DECK CONNECTING SYSTEM

(71) Applicant: Donald E. Wheatley, Holland, MI (US)

(72) Inventor: Donald E. Wheatley, Holland, MI (US)

( * ) Notice: Subject to any disclaimer, the term of this patent is extended or adjusted under 35 U.S.C. 154(b) by 0 days.

(21) Appl. No.: 15/883,828

(22) Filed: Jan. 30, 2018

(65) Prior Publication Data

US 2018/0320362 A1 Nov. 8, 2018

Related U.S. Application Data

(60) Provisional application No. 62/500,790, filed on May 3, 2017.

(51) Int. Cl.

| | |
|---|---|
| ***E04B 1/61*** | (2006.01) |
| ***E04B 1/21*** | (2006.01) |
| ***E04B 1/38*** | (2006.01) |
| ***E04B 1/41*** | (2006.01) |
| *E04B 1/48* | (2006.01) |

(52) U.S. Cl.

CPC ..... *E04B 1/21* (2013.01); *E04B 1/215* (2013.01); *E04B 1/383* (2013.01); *E04B 1/40* (2013.01); *E04B 1/483* (2013.01); *E04B 2001/405* (2013.01)

(58) Field of Classification Search

CPC ..... E04B 1/61; E04B 2001/3276; E04B 2001/3288; E04B 5/023; E04B 1/41; E04B 1/21; E04B 1/215

See application file for complete search history.

(56) References Cited

U.S. PATENT DOCUMENTS

| | | | | | |
|---|---|---|---|---|---|
| 823,292 | A | * | 7/1905 | Robinson | |
| 1,912,429 | A | * | 6/1933 | Burgess | E01C 5/005 404/40 |
| 2,235,356 | A | * | 3/1941 | Byers | H02G 9/025 174/136 |
| 3,842,562 | A | * | 10/1974 | Daigle | E01C 5/08 404/50 |
| 3,958,954 | A | * | 5/1976 | Ehlenbeck | E04B 1/215 428/584 |
| 4,021,984 | A | * | 5/1977 | Honegger | B28B 23/00 52/471 |
| 4,441,293 | A | * | 4/1984 | McQueen | B63B 3/68 52/377 |
| 4,545,701 | A | * | 10/1985 | Tsuzuki | E21D 11/083 138/159 |
| 4,724,649 | A | * | 2/1988 | Lowndes, III | E04B 1/215 52/583.1 |

(Continued)

OTHER PUBLICATIONS https://schaefer-inc.com/parking-structure-options-pre-cast-vs-cast-in-place/, Schaefer Precast Parking Structure (Year: 2015).*

*Primary Examiner* — Brian E Glessner
*Assistant Examiner* — Daniel J Kenny
(74) *Attorney, Agent, or Firm* — Harness, Dickey & Pierce, P.L.C.

(57) ABSTRACT

A connecting system for connecting concrete beams of a parking structure including a pair of concrete beams and a plurality of spring-like connectors connected between the pair of concrete beams. The concrete beams are each provided with an aperture and the spring-like connector is in a form of a pre-formed carbon fiber bundle or metal and has opposite ends that are secured in the apertures in the concrete beams by an adhesive.

14 Claims, 5 Drawing Sheets

(56) References Cited

U.S. PATENT DOCUMENTS

| | | | | |
|---|---|---|---|---|
| 5,311,629 | A * | 5/1994 | Smith | E01D 22/00 14/73.1 |
| 6,185,897 | B1 * | 2/2001 | Johnson | E04B 1/41 52/582.1 |
| 7,637,071 | B2 * | 12/2009 | Pryor | E04G 23/0218 52/295 |
| 8,291,662 | B2 * | 10/2012 | McCorkle | E04B 1/483 52/393 |
| 8,367,569 | B2 * | 2/2013 | Wheatley | C04B 28/02 442/312 |
| 9,028,635 | B2 * | 5/2015 | Jeong | B29C 70/083 156/184 |
| 2003/0140590 | A1 * | 7/2003 | Lancelot, III | E01D 19/00 52/712 |
| 2005/0204671 | A1 * | 9/2005 | Heuvel | E04B 5/023 52/506.01 |
| 2015/0068154 | A1 * | 3/2015 | Merlob | E04G 23/0218 52/741.1 |
| 2018/0127968 | A1 * | 5/2018 | Ziehl | E04B 5/023 |

* cited by examiner

PARKING DECK CONNECTING SYSTEM

CROSS-REFERENCE TO RELATED APPLICATIONS

This application claims the benefit of U.S. Provisional Application No. 62/500,790, filed on May 3, 2017. The entire disclosure of the above application is incorporated herein by reference.

FIELD

The present disclosure relates to a connecting system for parking decks formed from concrete beams.

BACKGROUND

This section provides background information related to the present disclosure which is not necessarily prior art.

Parking structures and the like are commonly constructed with concrete beams. The concrete beams can be in the form of double tee beams, tee beams or other forms. Tee beams are so named because they have a T-shaped cross-section and double tee beams have a cross section of two T's side-by-side (TT). The known double tee beams are connected to adjacent double tee beams with welded metal clips that secure the concrete beams together as vehicles drive over the beams. The welded metal clips are provided at spaced intervals between the opposing faces of the double tee beams and are welded to metal plates embedded in the concrete beams. The welded connections commonly break due to corrosion, fatigue or overloading. Accordingly, it is desirable in the field of parking structures and the like to provide improved connections between the concrete beams that can be used as an original installation or as a retrofit/replacement of failed connectors.

SUMMARY

This section provides a general summary of the disclosure, and is not a comprehensive disclosure of its full scope or all of its features.

The present disclosure provides a connecting system for connecting concrete beams of a parking structure or the like. The connecting system includes a pair of concrete beams and a plurality of connectors connected between the pair of concrete beams. According to one aspect of the present disclosure, the concrete beams are each provided with an aperture and the connector has opposite ends that are secured in the apertures in the concrete beams by an adhesive. The apertures can be provided in a lower surface of the concrete beams. Alternative forms of brackets can also be used to secure the ends of the arch-shaped connectors to the beams. The connectors can be pre-formed in an arch-shape or other spring-like configuration having a cross-sectional diameter, shape and length that provide for controlled relative movement of the concrete beams. The connectors can be made from a bundle of carbon or other fibers, or other material such as metal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
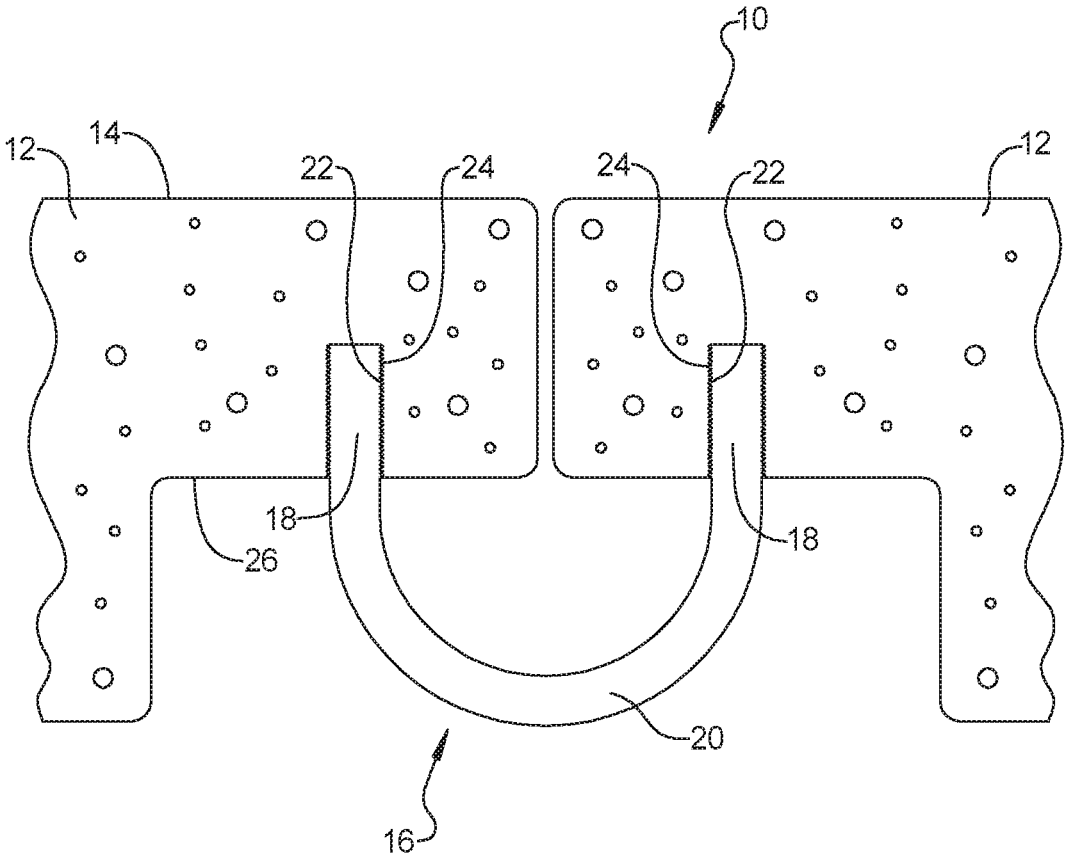
FIG. 1 is a partial cross-sectional view of a pair of concrete beams of a parking deck with a connecting system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
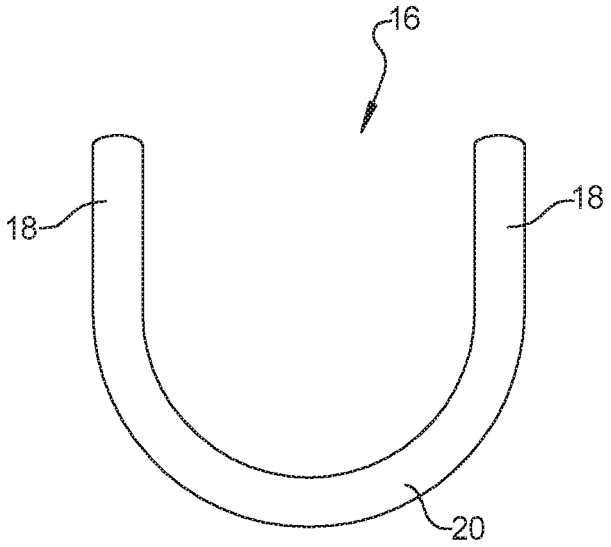
FIG. 2 is a perspective view of an spring-like connector according to the principles of the present disclosure.
Figure 6:
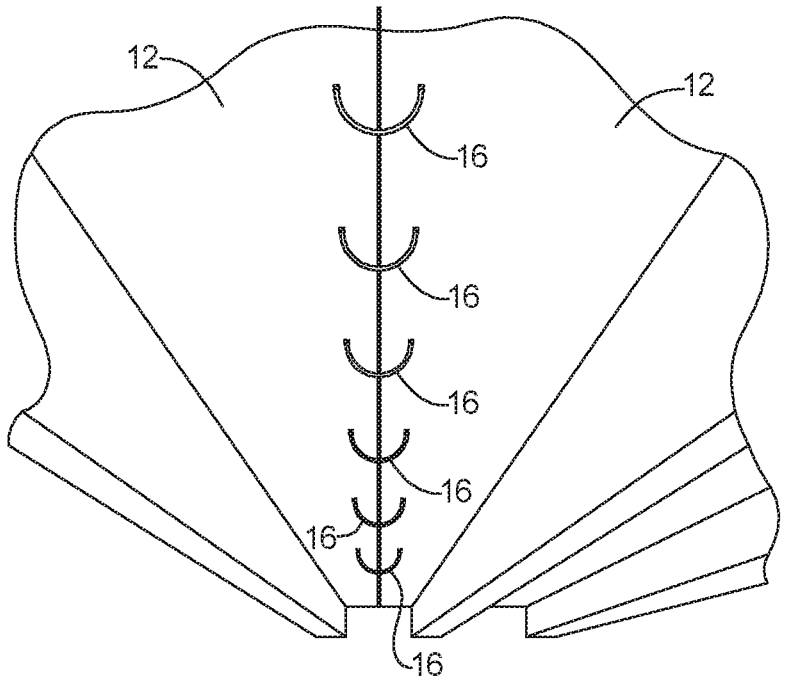
FIG. 6 is a perspective view of a pair of concrete beams of a parking deck with a plurality of spring-like connectors assembled along a seam therebetween according to the principles of the present disclosure.
Figure 8:
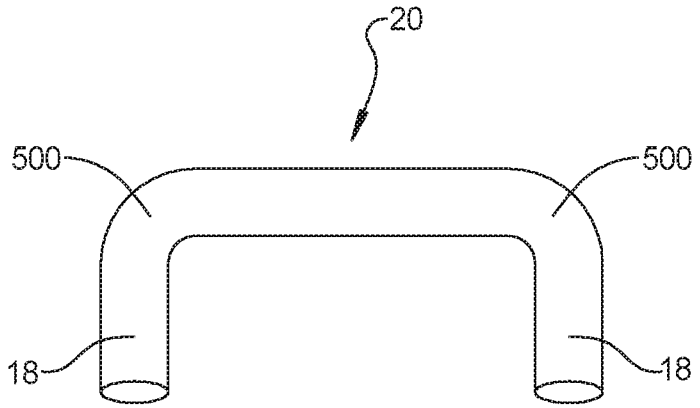
FIG. 8 is a perspective view of an alternative spring-like connector according to the principles of the present disclosure.
Figure 9:
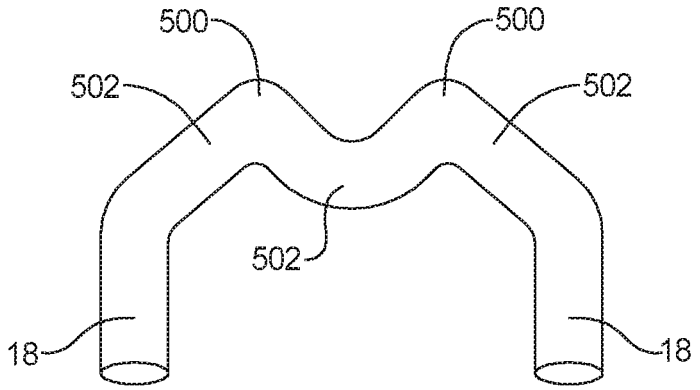
FIG. 9 is a perspective view of an alternative spring-like connector according to the principles of the present disclosure.

With reference to FIGS. 1, 2 and 6, a parking deck connecting system 10 according to the principles of the present disclosure will now be described. A portion of a parking deck is shown including first and second concrete beams 12 adjacent to one another. The concrete beams 12 can be tee beams or double tee beams. The concrete beams 12 combine to form a deck surface 14 on which the vehicles drive and are parked. The concrete beams 12 are supported at opposite ends by columns, beams and other structures (not shown). According to the principles of the present disclosure, the connecting system 10 includes a plurality of spring-like connectors 16 having a predetermined length defining first and second legs 18 and an arch-shaped intermediate portion 20 connected between the first and second legs 18. The intermediate portion 20 can have alternative shapes including one or more bends 500 or undulations 502 in order to provide a desired spring effect, as shown in FIGS. 8 and 9, respectively. The concrete beams 12 are each provided with a drilled or otherwise formed bore 22, in which each of the ends 18 of the connectors 16 are inserted and secured therein by an adhesive 24. As shown in FIG. 1, the bores 22 can be formed in a bottom surface 26 of the concrete beams 12. The spring-like connectors 16 can be formed from carbon or other fibers coated with a hardenable material such as an epoxy or from metal (such as spring steel) and be pre-formed in a desired arch-shape or other spring-like shape and to have a predetermined diameter and length so as to provide a desired amount of deflection and resistance to movement as the concrete beams 12 flex together as vehicles move across the deck surface 14. The spring-like connectors 16 are capable of flexing in multiple directions, vertical, lateral, longitudinal (X, Y, Z) and rotational.

As illustrated in FIG. 1, the arch-shaped intermediate portion 20 of the spring-like connectors 16 provides a spring effect by connecting the adjacent concrete beams 12 while allowing limited relative movement therebetween while the connectors flex. The diameter and shape of the intermediate portion 20 can be selected to provide desired performance characteristics. Each of the ends 18 can be parallel to one another in order to facilitate insertion in the bores 22. A plurality of spring-like connectors 16 can be utilized at spaced intervals along the length of the seam between the concrete beams 12, as shown in FIG. 6. A typical concrete beam length is 60 feet while the connectors can be installed at approximately 6 foot intervals along the length thereof. It should be understood that the spacing and/or length and diameter of the spring-like connectors 16 can be varied at different locations along the concrete beams 12 in order to provide a connecting system that is tailored to the varying degrees of relative movement at different locations along the concrete beams 12.

Figure 3:
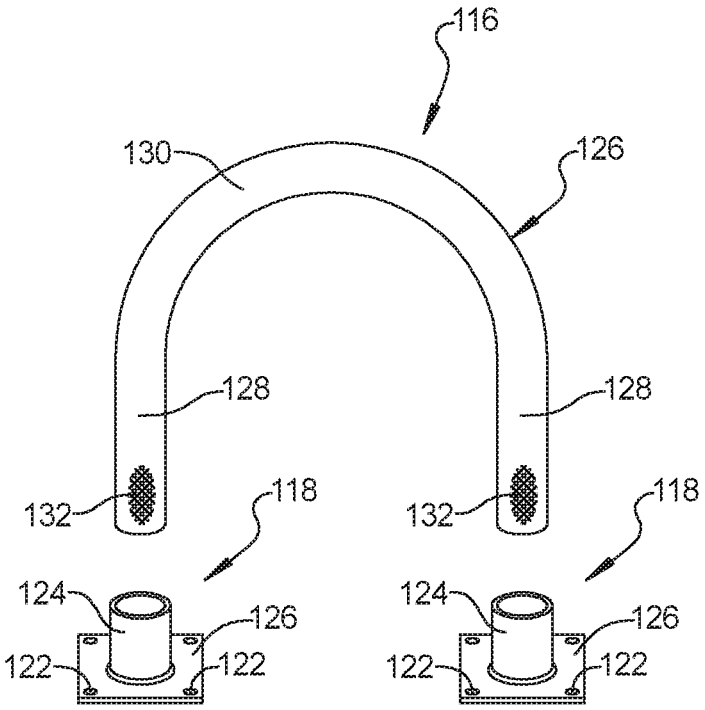
FIG. 3 is a perspective view of an alternative spring-like connector assembly according to the principles of the present disclosure.

With reference to FIG. 3, an alternative spring-like connector assembly 116 includes a pair of brackets 118 having a mounting plate with one or more bolt holes 122 and a hollow tube portion 124 that can be welded to the mounting plate 120. The pair of brackets 118 can be secured to the concrete beams 12 by bolts or screws inserted into the beams 12. The connector assembly further includes a spring-like bar 126 having a pair of legs 128 and an arch-shaped intermediate portion 130. The pair of legs 128 can be secured in the hollow tube portion 124 of the brackets 118 by an adhesive 132. The spring-like bar 126 can be made from carbon or other fibers coated with a hardenable material such as an epoxy or from metal (such as spring steel) and be pre-formed in a desired arch-shape or other spring-like shape and to have a predetermined diameter and length so as to provide a desired amount of deflection and resistance to movement as the concrete beams 12 flex together as vehicles move across the deck surface 14.

Figure 4:
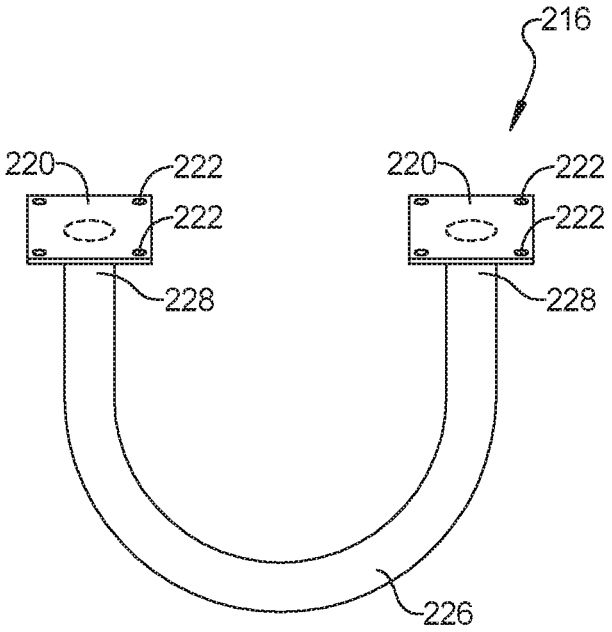
FIG. 4 is a perspective view of an alternative spring-like connector according to the principles of the present disclosure.

With reference to FIG. 4, an alternative spring-like connector 216 includes a pair of mounting plates 220 with one or more bolt holes 222. The mounting plates 220 can be welded to the ends 228 of a spring-like steel bar 226. The pair of brackets 220 can be secured to the concrete beams 12 by bolts or screws inserted into the beams 12. The spring-like steel bar 226 can be pre-formed in a desired arch-shape or other shape and to have a predetermined diameter and length so as to provide a desired amount of deflection and resistance to movement as the concrete beams 12 flex together as vehicles move across the deck surface 14.

Figure 5:
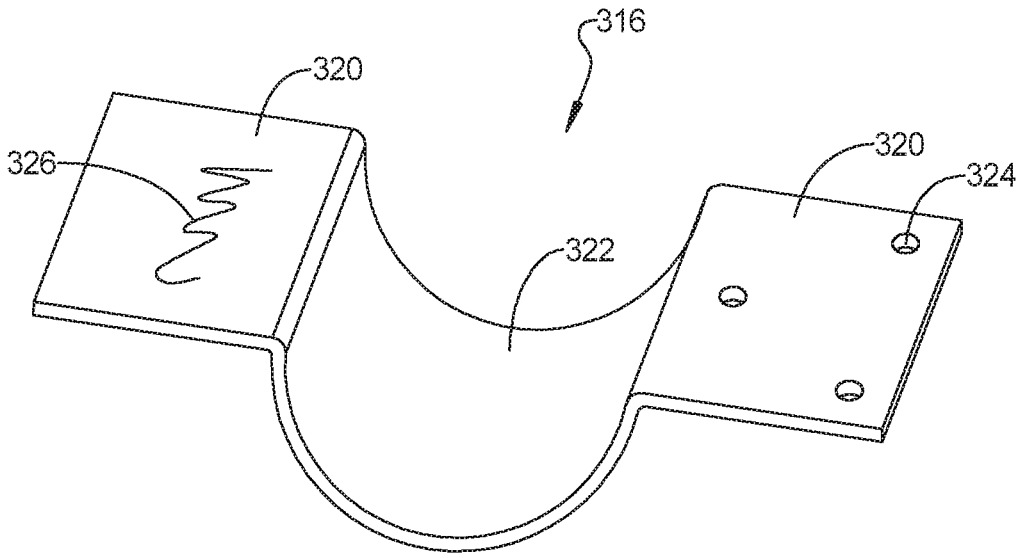
FIG. 5 is a perspective view of an alternative spring-like connector according to the principles of the present disclosure.

With reference to FIG. 5, an alternative embodiment of the spring-like connector 316 includes a pair of generally flat mounting portions 320 and a spring-like intermediate portion 322 extending between the pair of generally flat mounting portions 320. The mounting portions 320 can include one or more bolt holes 324 (as shown in the right portion of FIG. 5) for receiving a fastener for securing the connector 316 to the concrete beams 12 or, alternatively can be adhered to the concrete beams 12 by an adhesive 326 (as shown in the left portion of FIG. 5). The spring-like connectors 316 can be pre-formed from a flat sheet of metal that may include spring steel with the intermediate portion 322 in a desired arch-shape or other shape and to have a predetermined length so as to provide a desired amount of deflection and resistance to movement as the concrete beams 12 flex together as vehicles move across the deck surface 14.

Figure 7:
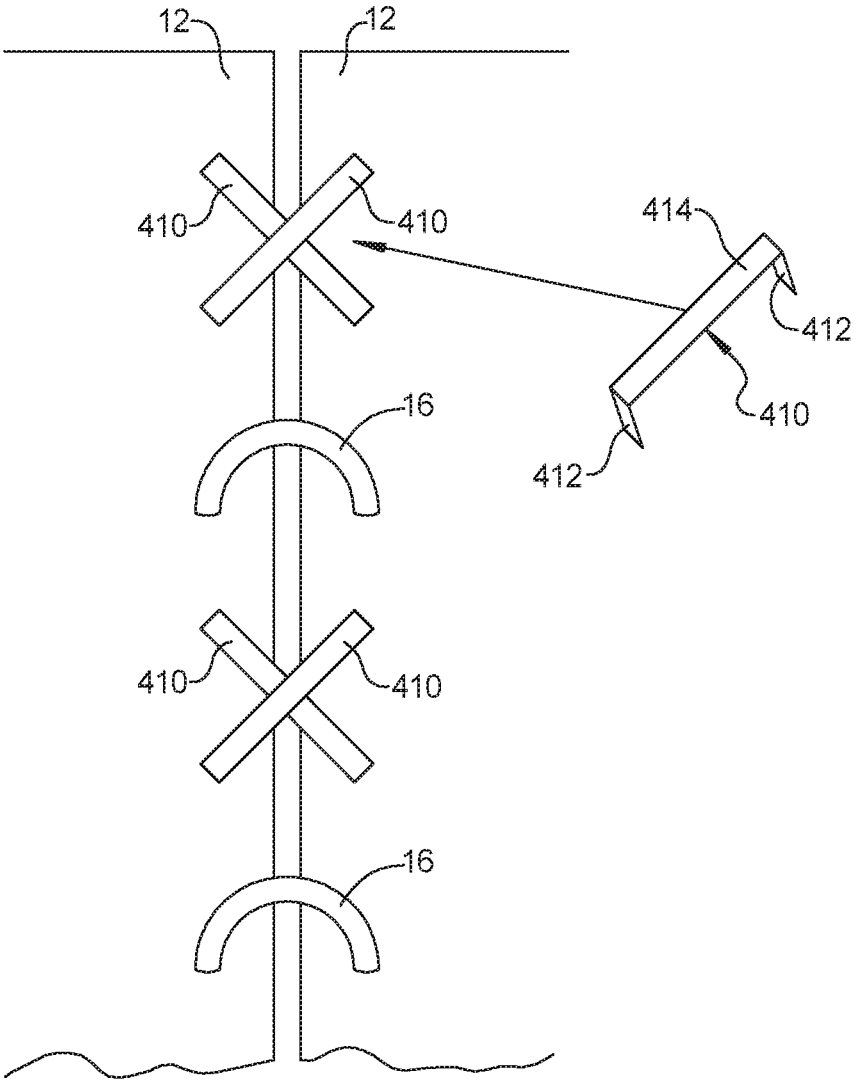
FIG. 7 is a schematic view of a pair of concrete beams with a connecting system assembled along a seam therebetween.

With reference to FIG. 7, a plurality of spring-like connectors 16 are shown at spaced intervals along the length of the seam between the concrete double tee beams 12. In addition, in order to prevent a sheering movement between the concrete beams 12, pairs of staple-shaped carbon fiber or metal brackets 410 can be mounted in an X-configuration across the seam between the concrete beams 12. In particular, the staple-shaped brackets 410 include a pair of legs 412 and a bridge portion 414 connected between the pair of legs 412. A pair of slots or holes 416 can be formed in the concrete beams 12 to receive the pair of legs 412 adhesively secured therein so that the bridge portion 414 diagonally traverses the seam between the adjacent concrete beams 12. With a pair of brackets 410 extending in an X-configuration, the brackets 410 prevent relative longitudinal (shear) movement of the concrete beams 12 in either direction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. In particular, the same may also be varied in many ways. Such variations are not to be regarded as a departure from the disclosure, and all such modifications are intended to be included within the scope of the disclosure.

What is claimed is:

1. A connecting system for connecting concrete beams of a parking structure, comprising:

a pair of concrete beams and a plurality of spring-like one-piece, arch shaped connectors connected between the pair of concrete beams, wherein the concrete beams are each provided with a plurality of apertures provided in a lower surface of the concrete beams and the plurality of one-piece, arch shaped connectors have an intermediate portion and a pair of opposite ends wherein the opposite ends are secured in the apertures in the concrete beams by an adhesive, and wherein the intermediate portion of the arch shaped connectors extend external to and below the pair of concrete beams.

2. The connecting system according to claim 1, wherein the spring-like one-piece, arch shaped connectors are pre-formed from carbon fibers.

3. The connecting system according to claim 2, wherein the carbon fibers are coated with a hardenable material.

4. The connecting system according to claim 1, wherein the spring-like one-piece, arch shaped connectors are made from metal.

5. The connecting system according to claim 1, wherein the spring-like one-piece, arch shaped connectors are formed from round carbon fiber bundles that have a cross-sectional diameter and length that provide for controlled relative movement of the concrete beams.

6. The connecting system according to claim 1, wherein the plurality of apertures are parallel to one another.

7. A connecting system for connecting concrete beams of a parking structure, comprising:

a pair of adjacent double tee concrete beams; and a plurality of spring-like one-piece, arch shaped connectors pre-formed from carbon fibers and having a pair of ends that are each connected to a bottom surface of a respective one of the pair of adjacent double tee concrete beams wherein an intermediate portion of the spring-like one-piece, arch shaped connectors extends below the bottom surface of the pair of adjacent double tee concrete beams.

8. The connecting system according to claim 7, wherein the carbon fibers are coated with a hardenable material.

9. The connecting system according to claim 7, wherein the pair of adjacent double tee concrete beams each include a plurality of parallel apertures provided in a lower surface and each of the plurality of spring-like one-piece, arch shaped connectors include a pair of legs received in the apertures in each of the adjacent double tee concrete beams.

10. The connecting system according to claim 7, wherein the spring-like one-piece, arch shaped connectors are formed from round carbon fiber bundles that have a cross-sectional diameter and length that provide for controlled relative movement of the concrete beams.

11. The connecting system according to claim 7, wherein the spring-like one-piece, arch shaped connectors include ends that are connected to the concrete beams by bolts.

12. The connecting system according to claim 7, wherein the pair of ends are connected to the concrete beams by an adhesive.

13. The connecting system according to claim 7, wherein the spring-like one-piece, arch shaped connectors include the pair of ends each having a mounting plate with at least one bolt hole for securing the spring-like connectors to the concrete beams.

14. The connecting system according to claim 7, wherein the pair of the ends of the spring-like one-piece, arch shaped connectors include a generally flat mounting portion.

* * * * *